US006322047B1

(12) United States Patent
Holmboe, Jr.

(10) Patent No.: US 6,322,047 B1
(45) Date of Patent: Nov. 27, 2001

(54) WALER CLAMP ASSEMBLY FOR A CONCRETE WALL FORM

(75) Inventor: J. Andrew Holmboe, Jr., Oklahoma City, OK (US)

(73) Assignee: Holmboe Mfg. Co., Inc., Oklahoma City, OK (US)

( * ) Notice: Subject to any disclaimer, the term of this patent is extended or adjusted under 35 U.S.C. 154(b) by 0 days.

(21) Appl. No.: 09/484,642

(22) Filed: Jan. 18, 2000

(51) Int. Cl.[7] ..... E04G 17/14
(52) U.S. Cl. ..... 249/219.2; 249/47
(58) Field of Search ..... 249/46, 219.1, 249/219.2, 47, 192

(56) References Cited

U.S. PATENT DOCUMENTS

| | | | | |
|---|---|---|---|---|
| 2,964,294 | | 12/1960 | Imonetti | 254/29 |
| 2,967,689 | * | 1/1961 | Jahn | 249/219.2 |
| 3,030,059 | * | 4/1962 | Jahn | 249/219.2 |
| 3,216,690 | * | 11/1965 | Jahn | 249/219.2 |
| 3,462,107 | * | 8/1969 | Buyken | 249/219.2 |
| 3,550,898 | * | 12/1970 | Ursini | 249/219.2 |
| 3,584,827 | | 6/1971 | Shoemaker | 249/45 |
| 3,599,929 | * | 8/1971 | Holley, Sr. | 249/219.2 |
| 3,655,162 | | 4/1972 | Shoemaker | 249/219 W |
| 3,945,602 | * | 3/1976 | Doubleday et al. | 249/219.1 |
| 5,562,845 | * | 10/1996 | Miller et al. | 249/219.1 |

OTHER PUBLICATIONS

Symons Corporation, p. J–25, Mar., 1981.
Symons Corporation, p. J–25A, Aug., 1992.
Symons Corporation, p. J–26, Jun., 1994.

* cited by examiner

*Primary Examiner*—Michael Safavi
(74) *Attorney, Agent, or Firm*—McAfee & Taft

(57) ABSTRACT

A waler clamp assembly for a concrete wall form. The waler clamp assembly comprises a waler clamp and a wedge engageable with the clamp to clamp a waler in place on the clamp. The clamp comprises an upper plate, a parallel lower plate, an end web interconnecting outer ends of the upper and lower plates, and a reinforcing leg interconnecting the upper and lower plates adjacent to the inner ends thereof The leg is preferably integrally formed with the lower plate. The leg extends upwardly away from the lower plate and outwardly toward the end web. The leg is preferably fixedly attached to the underside of the upper plate, such as by welding. The reinforcing leg strengthens the clamp so that there is no significant bending or twisting thereof due to driving the wedge in place.

20 Claims, 4 Drawing Sheets

WALER CLAMP ASSEMBLY FOR A CONCRETE WALL FORM

BACKGROUND OF THE INVENTION

1. Field of the Invention

This invention relates to waler clamp assemblies for temporarily holding concrete wall forms together, and more particularly, to a waler clamp assembly having a waler clamp with a reinforcing leg interconnecting upper and lower plates on the clamp to minimize deflection and twisting of the clamp.

2. Description of the Prior Art

Waler clamp assemblies for holding adjacent panels of a concrete wall form are well known. Generally, in forming concrete walls, the form is characterized by a pair of spaced apart form sides which define the size and shape of the wall and hold the concrete therebetween until it hardens. The form sides consist of a series of rectangular panels positioned edge to edge and attached to, and supported by, a frame. Typically, the panels are plywood, and the frame is made of steel. The waler clamp assemblies are used to temporarily connect to adjacent frames to hold a waler and thereby keep the wall forms aligned during pouring and hardening of the concrete. Some prior waler clamp assemblies are disclosed in U.S. Pat. Nos. 2,964,294; 3,584,827; and 3,655,162.

A simplified variation on some of the earlier waler clamp assemblies shown in these patents is illustrated in FIG. 1 and will be described in more detail herein. This waler clamp assembly uses a two-piece construction including the waler clamp itself and a wedge. The clamp has an upper plate with a hook that engages openings in vertical members of adjacent frames. A lower plate engages the vertical frame members at a location below the openings. The upper and lower plates are integrally formed with an outer end plate interconnecting them. A downwardly extending flange on the lower plate bears against the outer edge of the vertical members to support the clamp assembly.

A waler, generally in the form of a board, such as a 2×4 or 4×4, is positioned on the upper plate of the clamp and/or between the upper and lower plates thereof A wedge is driven substantially vertically through openings in the upper and lower plates to wedge against the waler to hold it firmly in place. The operation of the clamp assemblies and the walers is to provide a rigid support to keep the frames and panels aligned and straight during the pouring of the concrete between the form sides. This prior art waler clamp has been used for a long time, but it has no inherent support between the upper and lower plates at their inner ends adjacent to the vertical members of the frames. Eventually, in most clamps, after many uses, there is undesired downward deflection or twisting of the lower plate as a result of driving the wedge in place. This results in the waler not being adequately clamped in place which can cause misalignment of the wall form sides.

The waler clamp of the present invention solves this problem by providing the improvement of an inner reinforcing or support leg which interconnects the upper and lower plates at a position adjacent to the vertical members of the form side frames without interfering with the engagement of the hook on the upper panel with the openings in the vertical members. This prevents undesired deformation of the lower plate.

SUMMARY OF THE INVENTION

The present invention is a waler clamp assembly design for use with a form for concrete wall structures. The clamp assembly is an improvement of a prior art device.

The waler clamp assembly comprises a waler clamp and a wedge. The clamp comprises an upper plate having a hook thereon for engaging the wall form, a lower plate extending parallel and below the upper plate, an end web interconnecting the upper and lower plates adjacent to outer ends thereof, and a reinforcing leg interconnecting the upper and lower plates adjacent to inner ends thereof The upper and lower plates define openings therein. The wedge is disposed through the openings in the upper and lower plates of the waler clamp for wedging against a waler positioned on the upper plate.

The lower plate and the leg of the waler clamp are substantially the same width and intersect at a radiused corner. The radiused corner has a contact line thereon adapted for contacting the wall form when the waler clamp is in an operating position.

The upper plate, lower plate, end web and reinforcing leg of said waler clamp are integrally formed. The leg is fixedly attached to the upper plate. Preferably, the leg has an edge welded or otherwise attached to an underside portion of the upper plate.

The leg extends upwardly from the lower plate and outwardly toward the end web. That is, the leg has an upper edge space outwardly from said hook.

Numerous objects and advantages of the invention will become apparent from the following detailed description of the preferred embodiment and the drawings illustrating such embodiment.

DESCRIPTION OF A PRIOR ART WALER CLAMP ASSEMBLY

Figure 1:
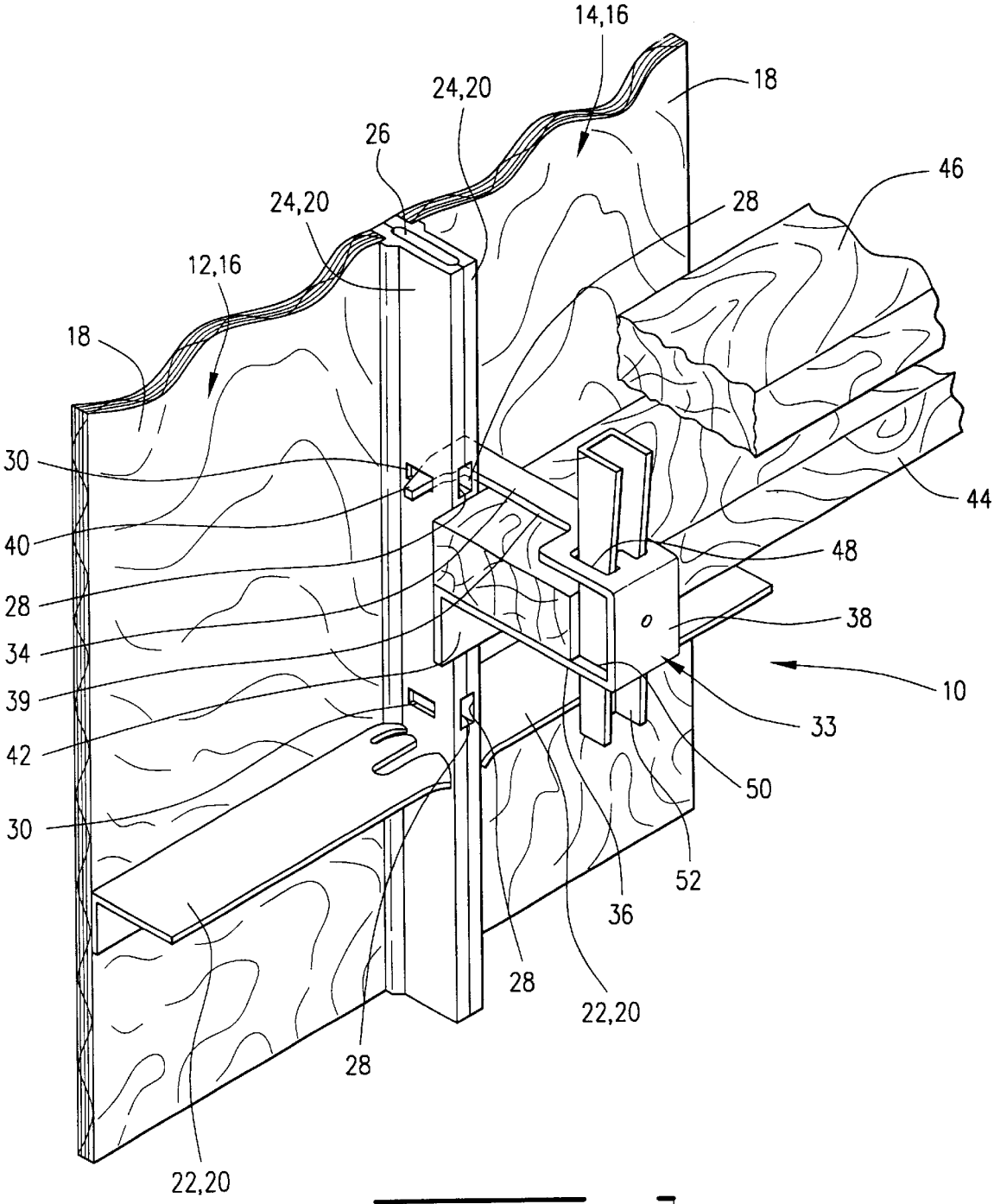
FIG. 1 PRIOR ART
FIG. 1 shows a perspective of a prior art two-piece waler clamp assembly in an operating position on a form side of a concrete wall form.

Referring now the drawings, and specifically to FIG. 1, a two-piece prior art waler clamp assembly is shown and generally designated by the numeral 10. Waler clamp 10 is shown in an operating position connecting adjacent sections 12 and 14 of a concrete wall form side 16. Another form side (not shown) is spaced away from form side 16 in a manner known in the art to form a volume therebetween into which concrete (not shown) is poured to form a concrete wall when hardened. As used herein, "inwardly" refers to a direction toward form side 16, and "outwardly" refers to a direction away from the form side.

Each of sections 12 and 14 includes a panel 18, such as a plywood sheet, and a frame 20. Frame 20 has a plurality of horizontal members 22 and vertical members 24. FIG. 1 shows adjacent vertical members 24 of adjacent sections 12 and 14. Vertical members define a vertically extending gap 26 therebetween. Vertical members 24 each have a series of vertically spaced and aligned notches 28 defined therein which are in communication with gap 26. Adjacent pairs of notches 28 will be seen to form an outwardly facing opening. Vertical members 24 also define a series of horizontal openings 30 therein which are generally located on the same vertical spacing as notches 28. A known form tie (not shown) may be positioned through the opening formed by notches 28 and thus through form 16 and the corresponding opposite form (also not shown) so that the forms are held together in a known manner.

Prior art waler clamp assembly 10 includes a waler clamp 33 having a horizontally extending upper plate or leg 34 which is spaced from a substantially parallel horizontal lower plate or leg 36. Upper and lower plates 34 and 36 are joined at their outer ends by a substantially vertical end plate or web 38. Upper plate 34 has a cutout 39 defined thereon to allow clearance for vertical members 24. On the inner end of upper plate 34 is a hook 40 which extends horizontally and generally parallel to form 16. Extending downwardly from the inner end of lower plate 36 is a substantially vertical flange 42.

In operation, prior art waler clamp 33 is positioned so that hook 40 extends through aligned horizontal openings 30 in vertical members 24. Flange 42 simply bears against vertical members 24 at a location below hook 40 and is not attached thereto.

FIG. 1 shows walers in the form of a pair of 2×4 boards, a lower board 44 and an upper board 46. Lower board 44 is positioned through the space in waler clamp 33 defined between upper and lower plates 34 and 36. Upper board 46 is positioned on top of upper plate 34.

Upper plate 34 defines a generally U-shaped opening 48 therein near end plate 38, and the U-shaped opening is above a generally rectangular opening 50 in lower plate 36. After locating walers 44 and 46, a wedge 52, the other component of waler clamp assembly 10, is placed generally vertically though openings 48 and 50 adjacent to the walers. Wedge 52 has a generally U-shaped cross-section corresponding to U-shaped opening 48, and the wedge tapers longitudinally. Wedge 52 is driven downwardly, and the tapered configuration forces the wedge toward form side 16 to lock walers 44 and 46 in place to make the entire structure a rigidly held and aligned single unit during pouring and hardening of the concrete. The lower end of wedge 52 is flared after installation in clamp 33 so that these components do not become inadvertently separated.

Other known fasteners (not shown) are used to connect adjacent vertical members 24 through other openings 30 at locations where walers are not used to keep adjacent form sides from separating.

A problem with prior art waler clamp 10 is that the inner end is open. That is, there is nothing interconnecting the inner ends of upper and lower plates 34 and 36. As a result, after many uses, the driving of wedge 52 in place will eventually cause upper and/or lower plates 34 and 36 to bend or twist. This can result in the misalignment of form sides 14 and 16 because of inadequate clamping on the walers. The present invention, which will now be discussed, solves this problem.

DESCRIPTION OF THE PREFERRED EMBODIMENT

Figure 2:
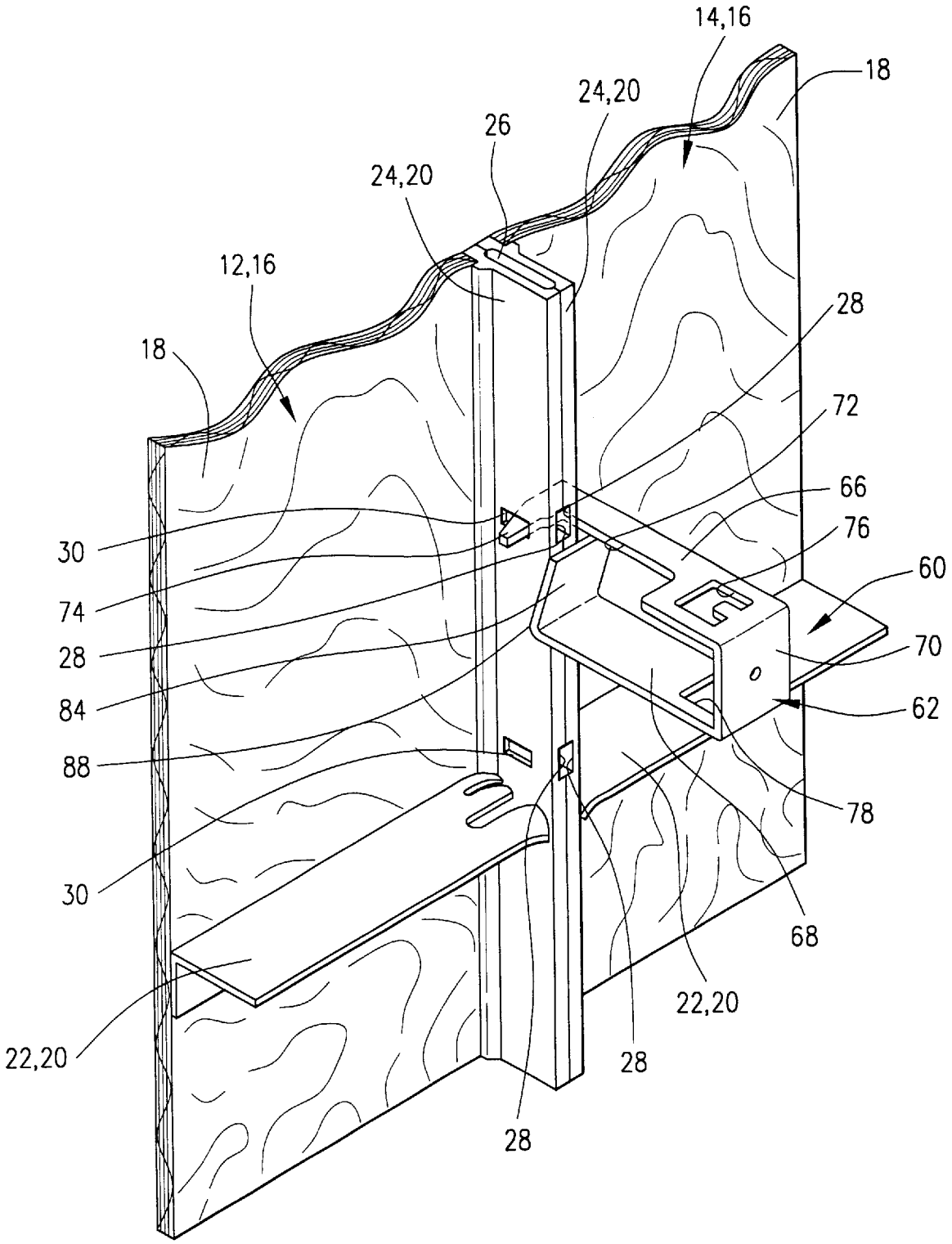
FIG. 2 illustrates a perspective view of the waler clamp portion of the waler clamp assembly of the present invention positioned on a concrete wall form.
Figure 3:
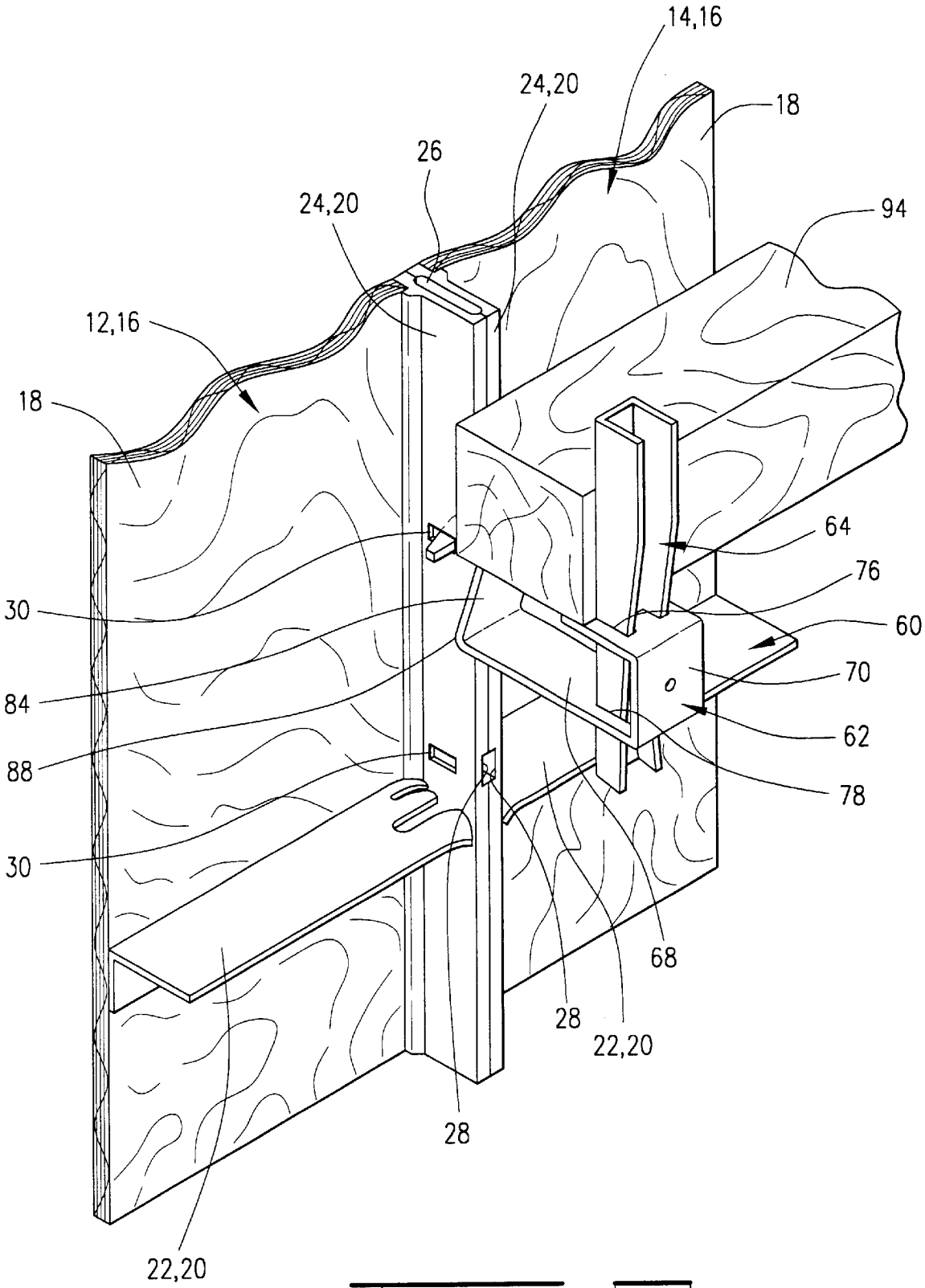
FIG. 3 is a perspective of the new waler clamp assembly in an operating position on the concrete wall form.

Referring now to FIGS. 2–5, the waler clamp assembly for a concrete wall form of the present invention is shown and generally designated by the numeral 60. Waler clamp assembly 60 comprises a waler clamp 62 and a wedge 64. As will be seen herein, many of the features of waler clamp 62 are substantially identical to waler clamp 33 of prior art waler clamp assembly 10. Wedge 64 is shown longer than prior art wedge 52 but is identical to other known wedges. That is, wedge 64 itself is not new. FIG. 2 shows waler clamp 62 after being positioned on form side 16. Wedge 64 is omitted from FIG. 2 for clarity. FIG. 3 shows waler clamp assembly 60 in an operating position. For the prior art components of form side 16, the same reference numerals will be used in FIGS. 2 and 3 as in the prior art illustration of FIG. 1. Thus, waler clamp assembly 60 is used to connect to adjacent sections 12 and 14 of form side 16. Sections 12 and 14 each include a frame 20 having horizontal members 22 and vertical members 24. Vertical members 24 have a gap 26 defined therebetween and notches 28 and openings 30 defined therein.

Waler clamp 62 has a horizontally extending upper plate or leg 66 which is spaced from a horizontal lower plate or leg 68. Upper and lower plates 66 and 68 are joined at their outer ends by a substantially vertical end plate or web 70. Upper plate 66 has a cutout 72 defined thereon which allows clearance for vertical members 24. On the inner end of upper plate 66 is a hook 74 which extends horizontally and generally parallel to form 16.

Upper plate 66 defines a generally U-shaped opening 76 therein, and lower plate 68 defines a generally rectangular opening 78 below opening 76. Openings 76 and 78 are adapted for receiving wedge 64 therethrough. Wedge 64 has a lower end thereof flared after assembly as in prior art assembly 10.

All of the above features described for waler clamp 60 are identical to prior art waler clamp 33.

Figure 4:
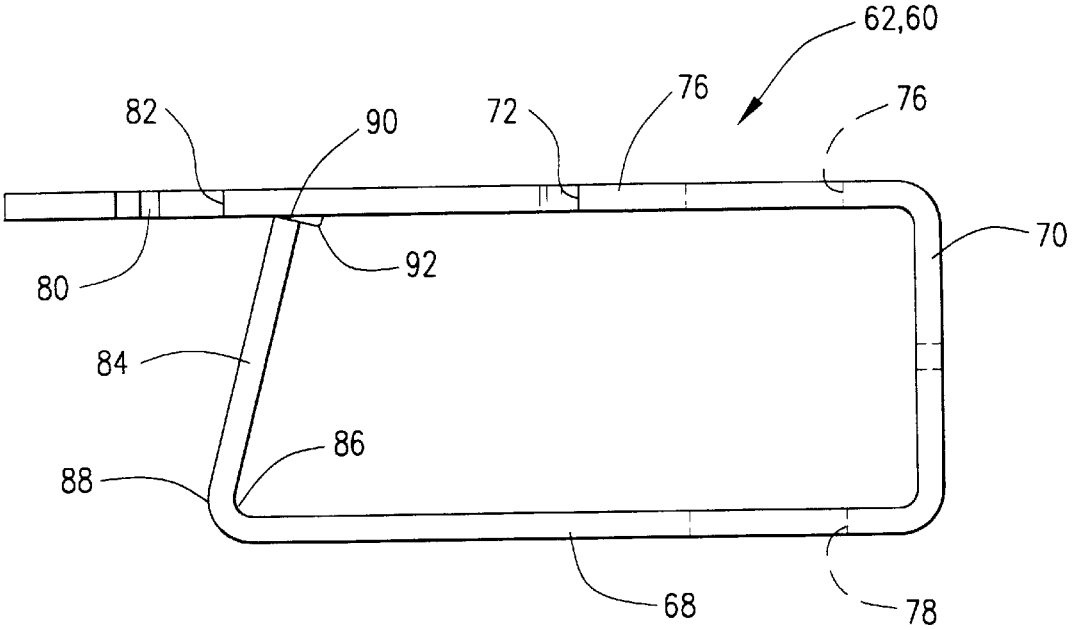
FIG. 4 is a side elevation view of the waler clamp.
Figure 5:
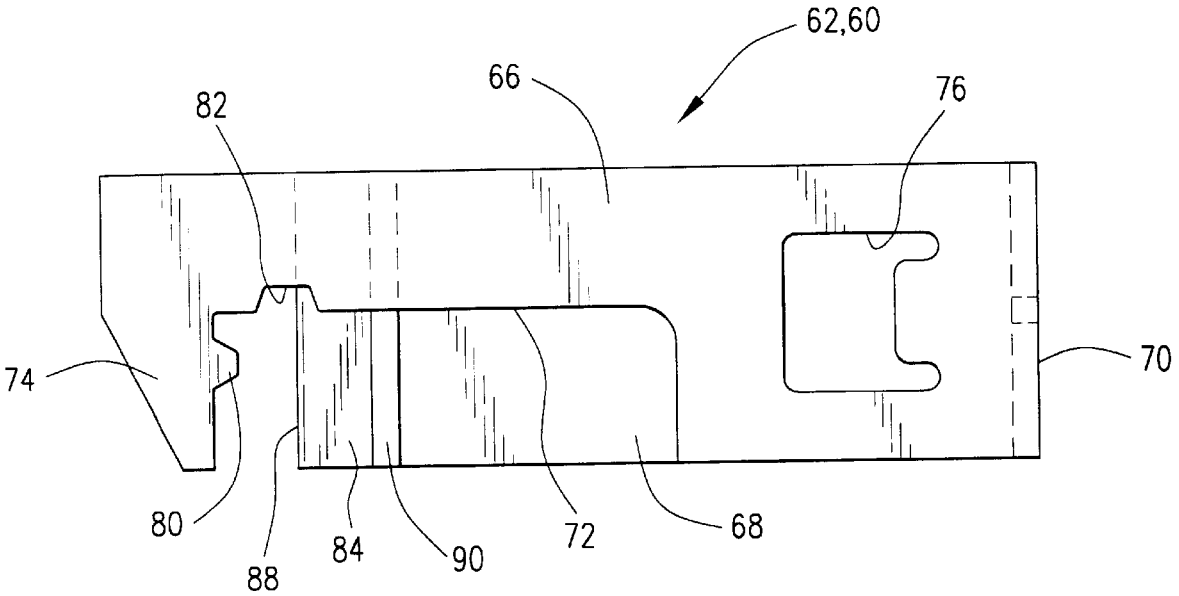
FIG. 5 shows a plan view of the waler clamp.

As seen in FIGS. 4 and 5, hook 74 has a tooth 80 thereon extending outwardly toward end plate 70. Upper plate 66 also defines a recess 82 therein. Tooth 80 and recess 82 are used to properly engage hook 74 with vertical members 24. Although not shown in FIG. 1 or previously discussed herein, tooth 80 and notch 82 are prior art features and not new in the present invention.

The new feature of waler clamp 60 is that it comprises a reinforcing leg or web 84 which extends upwardly and outwardly from the inner end of lower plate 68. Preferably, leg 84 and lower plate 68 are integrally formed, although they could be separate pieces connected together as by welding. Alternately, leg 84 and upper plate 66 could be integrally formed. In the illustrated embodiment, the intersection of leg 84 and lower plate 68 includes a radiused corner 86. Leg 84 has an inward most contact surface 88 which, as will be further described, is adapted for contacting and bearing against vertical members 24 below hook 74. Leg 84 has an upper edge 90 which contacts the underside of upper plate 66. Thus, leg 84 interconnects upper plate 66 and lower plate 68 at inward positions therein. Edge 90 of leg 84 is fixedly attached to upper plate 66, such as by a weld 92 or other means known in the art.

Leg 84 preferably extends upwardly and outwardly to provide the proper clearance for hook 74 when positioning the hook through openings 30 in vertical members 24 so waler clamp 62 may be placed in position as shown in FIG. 2.

Referring again to FIG. 3, waler clamp assembly 60 is shown in its operating position similar to prior art FIG. 1. FIG. 3 shows a waler 94 in the form of a board, such as a 4×4, positioned on upper plate 66. Other boards, such as one or more 2×4's, could also be used. Wedge 62 is driven downwardly in openings 76 and 78 to force waler 94 against form side 16 to lock the waler in place to make the entire structure a rigidly held and aligned single unit during pouring and hardening of the concrete. Because of reinforcing leg 84 a waler cannot be positioned between upper and lower plates 66 and 68, but that has proved not to be a problem either in the present invention or the prior art.

Because of the reinforcing provided at the inner portion of waler clamp 62 by reinforcing leg 84, the deflection and twisting problems of prior art clamp assembly 10 are eliminated in clamp assembly 60 of the present invention. Thus, the present invention greatly improves on the prior art.

It will be seen, therefore, that the waler clamp assembly for a concrete wall form of the present invention is well adapted to carry out the ends and advantages mentioned as well as those inherent therein. While a preferred embodiment of the invention has been shown for the purposes of this disclosure, numerous changes in the arrangement and construction of the parts may be made by those skilled in the art. All such changes are encompassed within the scope and spirit of the appended claims.

What is claimed is:

1. A waler clamp for use with a concrete wall form, said clamp comprising:

an upper plate having a hook thereon for engaging the wall form;

a lower plate disposed below said upper plate and substantially parallel thereto;

an end web interconnecting outer ends of said upper and lower plates; and a reinforcing leg interconnecting said upper and lower plates adjacent to inner ends thereof, a portion of said reinforcing leg adjacent to said upper plate being spaced from said hook such that proper clearance is provided for said hook to engage the wall form.

2. The clamp of claim 1 wherein said reinforcing leg is integrally formed with said lower plate.

3. The clamp of claim 2 wherein said lower plate and said leg intersect at a radiused corner.

4. The clamp of claim 3 wherein said radiused corner has a contact line thereon adapted for contacting said wall form when the clamp is in an operating position.

5. The clamp of claim 1 wherein said upper plate, lower plate, end web and reinforcing leg are integrally formed.

6. The clamp of claim 1 wherein said leg is fixedly attached to said upper plate.

7. The clamp of claim 6 wherein said leg has an edge welded to an underside portion of said upper plate.

8. The clamp of claim 1 wherein said leg has an upper edge spaced outwardly from said hook.

9. The clamp of claim 1 wherein the width of said leg is substantially the same as said lower plate.

10. A waler clamp for use with a concrete wall form, said clamp comprising:

an upper plate having a hook thereon for engaging the wall form;

a lower plate disposed below said upper plate and substantially parallel thereto;

an end web interconnecting said outer ends of said upper and lower plates; and a reinforcing leg interconnecting said upper and lower plates adjacent to inner ends thereof, said leg extending upwardly from said lower plate and outwardly toward said end web.

11. A waler clamp assembly for use with a form for concrete wall structures, said assembly comprising:

a waler clamp comprising:

an upper plate having a hook thereon for engaging the wall form, said upper plate defining an opening therein;

a lower plate extending parallel and below said upper plate, said lower plate defining an opening therein;

an end web interconnecting said upper and lower plates adjacent to outer ends thereof; and a reinforcing leg interconnection said upper and lower plates adjacent to inner ends thereof, a portion of said reinforcing leg adjacent to said upper plate being spaced from said hook such that proper clearance is provided for said hook to engage the wall form; and a wedge disposed through said openings in said upper and lower plates of said waler clamp and therby wedging against a waler positioned on said upper plate.

12. The assembly of claim 11 wherein said reinforcing leg is integrally formed with said lower plate.

13. The assembly of claim 12 wherein said lower plate and said leg of said waler clamp intersect at a radiused corner.

14. The assembly of claim 13 wherein said radiused corner has a contact line thereon adapted for contacting said wall form when said waler clamp is in an operating position.

15. The assembly of claim 11 wherein said upper plate, lower plate, end web and reinforcing leg of said waler clamp are integrally formed.

16. The assembly of claim 11 wherein said leg is fixedly attached to said upper plate.

17. The assembly of claim 16 wherein said leg has an edge welded to an underside portion of said upper plate.

18. The assembly of claim 11 wherein said leg has an upper edge spaced outwardly from said hook.

19. The assembly of claim 11 wherein the width of said leg is substantially the same as said lower plate.

20. A waler clamp assembly for use with a form for concrete wall structures, said assembly comprising:

a waler clamp comprising:

an upper plate having a hook thereon for engaging the wall form, said upper plate defining an opening therein;

a lower plate extending parallel and below said upper plate, said lower plate defining an opening therein;

an end web interconnecting said upper and lower plates adjacent to outer ends thereof; and a reinforcing leg interconnecting said upper and lower plates adjacent to inner ends thereof, said leg extending upwardly from said lower plate and outwardly toward said end web; and a wedge disposed through said openings in said upper and lower plates of said waler clamp and thereby wedging against a waler positioned on said upper plate.

* * * * *

UNITED STATES PATENT AND TRADEMARK OFFICE

CERTIFICATE OF CORRECTION

PATENT NO. : 6,322,047 B1
DATED : November 27, 2001
INVENTOR(S) : J. Andrew Holmboe, Jr.

It is certified that error appears in the above-identified patent and that said Letters Patent is hereby corrected as shown below:

Column 6,
Line 11, delete "interconnection" and insert -- interconnecting --
Line 17, delete "therby" and insert -- thereby -- therefor.

Signed and Sealed this

Twenty-first Day of May, 2002

*Attest:*

*Attesting Officer*

JAMES E. ROGAN
*Director of the United States Patent and Trademark Office*